US006758922B2

(12) United States Patent
Hamilton

(10) Patent No.: US 6,758,922 B2
(45) Date of Patent: Jul. 6, 2004

(54) LOW FIRING ENERGY INITIATOR PYROTECHNIC MIXTURE

(75) Inventor: Brian K. Hamilton, Ogden, UT (US)

(73) Assignee: Autoliv ASP, Inc., Ogden, UT (US)

( * ) Notice: Subject to any disclaimer, the term of this patent is extended or adjusted under 35 U.S.C. 154(b) by 211 days.

(21) Appl. No.: 09/972,463

(22) Filed: Oct. 5, 2001

(65) Prior Publication Data

US 2003/0066583 A1 Apr. 10, 2003

(51) Int. Cl.[7] ..... C06B 29/00; F42C 19/00
(52) U.S. Cl. ..... 149/75; 102/201; 102/202.5
(58) Field of Search ..... 149/75; 102/202.5, 102/201, 202.7, 202.11, 202.14

(56) References Cited

U.S. PATENT DOCUMENTS

| | | | | |
|---|---|---|---|---|
| 43,021 | A | | 6/1864 | Halvorson |
| 691,919 | A | | 1/1902 | Stire |
| 2,941,352 | A | | 6/1960 | St. John, Jr. |
| 2,952,876 | A | * | 9/1960 | Miles |
| 2,988,876 | A | * | 6/1961 | Walden |
| 2,988,877 | A | * | 6/1961 | Shope |
| 3,008,417 | A | * | 11/1961 | Keathley et al. |
| 3,028,273 | A | | 4/1962 | Proell |
| 3,203,843 | A | | 8/1965 | Jackson |
| 3,214,308 | A | | 10/1965 | Rice |
| 3,793,100 | A | | 2/1974 | Fronabarger |
| 4,128,443 | A | | 12/1978 | Pawlak et al. |
| 4,708,060 | A | * | 11/1987 | Bickes, Jr. et al. ..... 102/202.7 |
| 4,994,125 | A | | 2/1991 | Mei |
| 5,431,103 | A | | 7/1995 | Hock et al. |
| 5,467,715 | A | | 11/1995 | Taylor et al. |
| 5,485,790 | A | | 1/1996 | Hamilton |
| 5,542,704 | A | | 8/1996 | Hamilton et al. |
| 5,573,565 | A | * | 11/1996 | Dalton et al. ..... 65/59.1 |
| 5,670,740 | A | | 9/1997 | Barnes et al. |
| 5,686,691 | A | | 11/1997 | Hamilton et al. |
| 5,765,866 | A | | 6/1998 | Canterberry et al. |
| 5,914,458 | A | * | 6/1999 | Folsom et al. ..... 102/201 |
| 6,073,963 | A | | 6/2000 | Hamilton et al. |
| 6,136,113 | A | | 10/2000 | Wheatley et al. |
| 6,217,788 | B1 | * | 4/2001 | Wucherer et al. ..... 252/5 |
| 6,311,621 | B1 | * | 11/2001 | Marshall et al. ..... 102/202.5 |

FOREIGN PATENT DOCUMENTS

| | | |
|---|---|---|
| DE | 177 687 | 4/1905 |
| GB | 862 289 | 3/1961 |

OTHER PUBLICATIONS

Degussa–Iron Blue Pigments for Printing Inks, *Technical Bulletin Pigments*, pp. 3–5, 8, 9, 11, 13 and 32, No. 20.

* cited by examiner

*Primary Examiner*—Michael J. Carone
*Assistant Examiner*—Aileen B. Felton
(74) *Attorney, Agent, or Firm*—Sally J. Brown; James D. Erickson

(57) ABSTRACT

Pyrotechnic compositions such as used in initiator devices and corresponding initiator devices having a low firing energy are provided. The pyrotechnic composition includes a mixture containing a fuel component which includes a quantity of at least one Iron Blue Pigment and an oxidizer component which includes at least one oxidizer effective, upon reaction initiation with at least a portion of the quantity of the at least one Iron Blue Pigment, to produce gaseous reaction products.

18 Claims, 1 Drawing Sheet

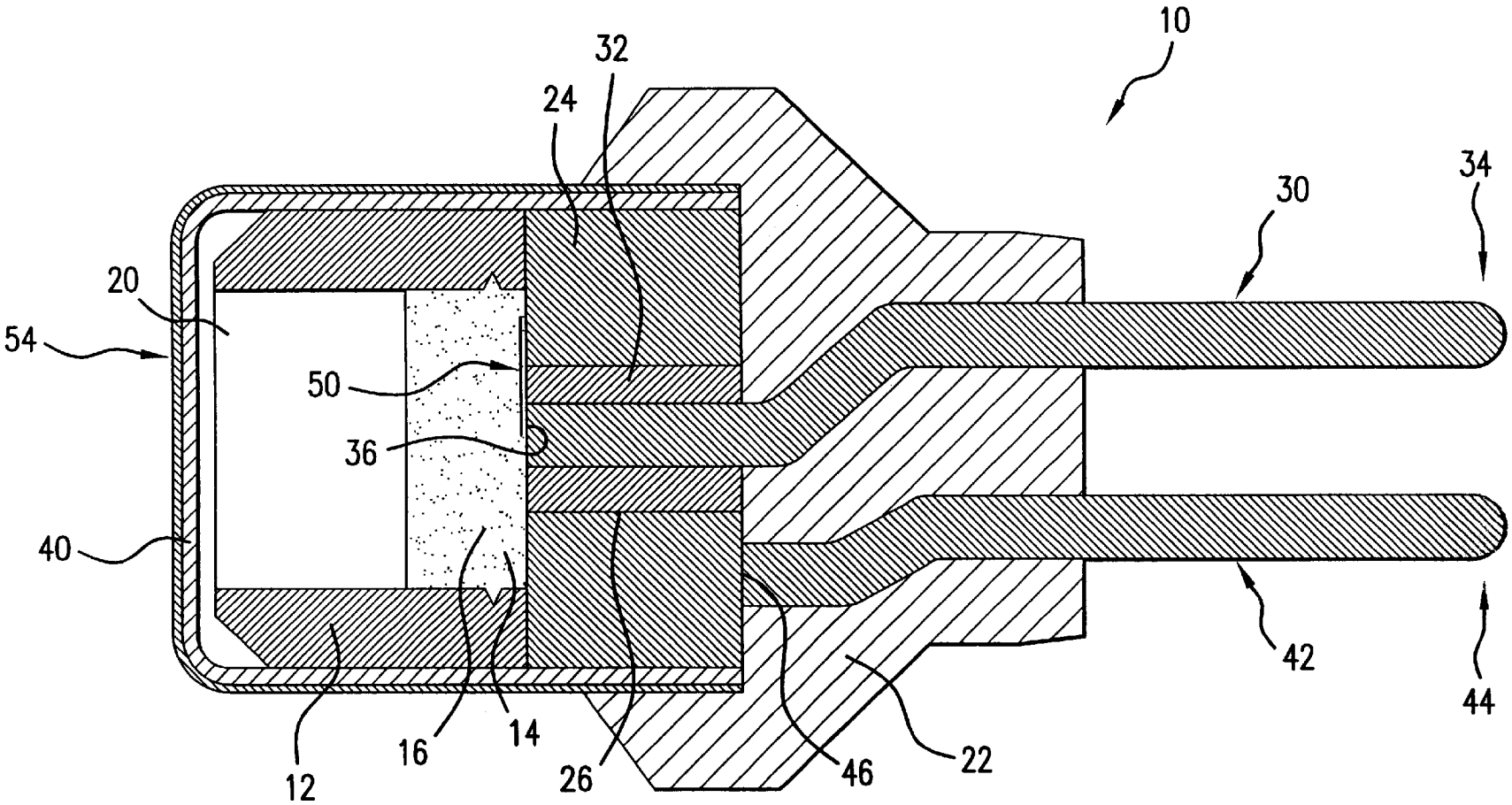
FIGURE

LOW FIRING ENERGY INITIATOR PYROTECHNIC MIXTURE

BACKGROUND OF THE INVENTION

This invention relates generally to pyrotechnic mixtures and, more particularly, to pyrotechnic mixtures for use in initiator devices having a low firing energy.

Initiator devices or assemblies, such as composed of an initiator transducer and a supply of energetic and rapid burning primer material, have been developed for use in various assemblies. For example, inflatable restraint systems such as used in the protection of vehicle occupants in the event of a collision commonly include or incorporate one or more gas generating or supplying devices each commonly referred to as an "inflator." Inflators used for inflating one or more inflatable airbag cushion or similar inflatable element typically include an initiator device or assembly for igniting a supply of gas generant reactant housed or contained within the inflator housing.

Common primer materials used in such initiator devices or assemblies include lead styphnate and zirconium potassium perchlorate (commonly referred to as "ZPP"), as well as other pyrotechnic mixtures or formulations. Unfortunately, various of such common or conventional primer materials, while energetic and rapidly burning, are typically difficult to handle in a desirably safe manner. Further, at least some such common or conventional primer materials may require exposure to a higher than desired firing energy in order to effect initiation or reaction thereof.

In addition, where such primer materials are used in or as a part of a gas generating or supplying device, primer materials which, upon reaction, additionally generate, produce or otherwise provide additional gaseous products are generally highly desirable as such additional gaseous products can supplement the gas otherwise provided or supplied thereby. For example, in various inflatable restraint system inflator applications, it may be desirable to employ an initiator device primer pyrotechnic formulation that itself forms gaseous products upon the reaction thereof.

In view of the above, there is a need and a demand for improved pyrotechnic compositions. In particular, there is a need and a demand for a pyrotechnic composition such as may be used as a primer material in initiator devices and such as may provide or result in increased or improved safety in handling, as compared to conventional primer materials. Further, there is a need and a demand for a pyrotechnic composition such as may be used as a primer material in initiator devices and such as may require exposure to a suitably lower or reduced firing energy, as compared to conventional primer materials, in order to effect initiation or reaction thereof. Still further, there is a need and a demand for a pyrotechnic composition such as may be used as a primer material in initiator devices and such as may produce, provide or otherwise desirably result in the formation of additional gaseous reaction products.

SUMMARY OF THE INVENTION

A general object of the invention is to provide an improved pyrotechnic composition.

Another general object of the invention is to provide an improved initiator device having a low firing energy.

A more specific objective of the invention is to overcome one or more of the problems described above.

The general object of the invention can be attained, at least in part, through a gas generant pyrotechnic composition which includes a mixture containing:

a fuel component comprising a quantity of at least one Iron Blue Pigment and an oxidizer component comprising at least one oxidizer effective, upon reaction initiation with at least a portion of the quantity of the at least one Iron Blue Pigment, to produce gaseous reaction products.

The prior art generally fails to provide an initiator pyrotechnic mixture having either or both as low as may be desired firing energy and which facilitates or otherwise more easily permits handling in a desirably safe manner.

The invention further comprehends, in accordance with another preferred embodiment of the invention, an initiator device which includes a charge holder housing containing a gas generant pyrotechnic composition, such as described above, and an initiator transducer in reaction initiating communication with at least a portion of the gas generant pyrotechnic composition contents of the housing.

In accordance with still another preferred embodiment, the invention further comprehends an initiator device which includes a charge holder housing containing a gas generant pyrotechnic composition and an initiator transducer in reaction initiating communication with at least a portion of the gas generant pyrotechnic composition contents of the housing. The gas generant pyrotechnic composition includes:

- a fuel component comprising a quantity of at least one Iron Blue Pigment, the gas generant pyrotechnic composition having an Iron Blue Pigment relative content of about 30 to about 50 wt. %,
- an oxidizer component comprising potassium perchlorate and effective, upon reaction initiation with at least a portion of the quantity of the at least one Iron Blue Pigment, to produce gaseous reaction products, the gas generant pyrotechnic composition having a potassium perchlorate relative content of about 50 to about 70 wt. %, and
- at least about 0.25 wt. % and no more than about 5 wt. % of at least one additive selected from the group consisting of binders, rheology enhancers and wetting agents.

As used herein, references to "Iron Blue Pigment" are to be understood to generally refer to that class, family or variety of pigment materials based on microcrystalline Fe(II)Fe(III) cyano complexes. According to results obtained by X-ray and infra-red spectroscopy, the basic general chemical formula for the Iron Blue Pigments is believed to be:

$$Me(I)Fe(H)Fe(III)(CN)_6.H_2O \quad (1)$$

In this formula, Me(I) stands for potassium, sodium or ammonium, with the alkali ion being believed to play a decisive role in the color properties of Iron Blue. Iron Blue Pigments, also sometimes referred to as "iron ferricyanides" have been produced or sold under a variety of different names related to either the place where the compound was made or to represent particular optical properties. Examples of such different names include: "Berlin Blue", "Bronze Blue", "Chinese Blue", "Milori Blue", "Non-bronze Blue", "Paris Blue", "Prussian Blue", "Toning Blue" and "Turnbull's Blue", for example.

Other objects and advantages will be apparent to those skilled in the art from the following detailed description taken in conjunction with the appended claims and drawings.

BRIEF DESCRIPTION OF THE DRAWING

The FIGURE is a simplified sectional schematic of an initiator device in accordance with one embodiment of the invention.

DETAILED DESCRIPTION OF THE INVENTION

The present invention provides improved pyrotechnic compositions such as used in initiator devices and improved initiator devices having a low firing energy. The compositions of the invention are high energy compositions which are particularly suited as ignition or primer materials. Further, the compositions of the invention, as described in greater detail below, are relatively safe to handle in either a slurry or dry form, as compared to currently used initiator primer materials such as lead styphnate and ZPP, for example. Still further, the compositions of the invention advantageously produce, provide or otherwise desirably result in the formation of additional gaseous reaction products.

Such gas generant pyrotechnic compositions typically include a mixture containing a fuel component comprising a quantity of at least one Iron Blue Pigment and an oxidizer component comprising at least one oxidizer effective, upon reaction initiation with at least a portion of the quantity of the at least one Iron Blue Pigment, to produce gaseous reaction products.

Iron Blue Pigment is a non-toxic material widely used in printing inks of various types. Iron Blue Pigment is generally characterized by very fine inherent particle size (typically in the order of about 0.025 microns). Further, Iron Blue Pigment is thermally stable over the temperature range of interest (e.g., temperatures between about −40° C. and 107° C.), non-hygroscopic (insoluble) and non-corrosive in the environment of an airbag inflator.

Those skilled in the art and guided by the teachings herein provided will appreciate that, as identified above, a wide variety of specific or particular Iron Blue Pigment iron ferrocyanide materials are available. MANOX-Blue 4050 Iron Blue Pigment iron ferrocyanide produced or sold by Degussa Corp. is a currently preferred Iron Blue Pigment material for use in the practice of the invention as this material has been found to generally exhibit a relatively high sensitivity to bridgewire activation in initiator device applications.

According to Degussa product literature, MANOX-Blue Iron Blue Pigment manufacture results by precipitation from complex alkali iron (II) cyanides and iron (II) salts in aqueous solutions. In this two-step method, a whitish precipitate is stated as being formed of alkali iron(II) hexacyanoferrate(II) of formula $Me(I)_2Fe(II)[Fe(II)(CN)_6]$. The Degussa product literature further states that by means of special precipitation parameters such as concentration of the solutions, temperature, and pH level during the precipitation, important pigment properties are determined during this step of the process. The production process continues with an ageing period having a length and temperature which varies depending on the type of pigment and then by oxidation to the finished blue pigment material.

A variety of oxidizer materials, such as known in the art, can be used or included in the pyrotechnic compositions of the invention. Examples of such oxidizer materials useable in the practice of the invention include potassium chlorate, strontium nitrate and ammonium perchlorate. Potassium perchlorate is a currently preferred oxidizer material for use in the practice of the invention as such material has been found to generally provide or result in desired reactivity and reaction sensitivity.

In general, preferred pyrotechnic compositions in accordance with the invention will contain or include about 50 to about 70 wt. % potassium perchlorate and have an Iron Blue Pigment relative content of about 30 to about 50 wt. %.

If desired and in accordance with certain preferred embodiments of the invention, the pyrotechnic composition may additionally contain or include a small amount, typically between about 0.25 wt. % and no more than about 5 wt. %, of one or more additives such as selected from the group consisting of binders, rheology enhancers and wetting agents. Examples of suitable such additive materials include materials such as hydroxypropyl cellulose, ethyl cellulose, and fluoroelastomers based on the copolymer of vinylidene fluoride and hexafluoropropylene and sold under the name VITON by Du Pont de Nemours, E.I. & Company, for example, which can serve primarily as binders. Further, as iron ferrocyanide typically has a very small and fine crystal structure, it has been found generally advantageous to include a quantity of a wetting agent additive to the mixture to avoid or reduce the undesirable formation of clumps by the iron ferrocyanide. Thus, a gas generant pyrotechnic composition in accordance with a preferred embodiment of the invention will desirably include or contain a wetting agent such as the maleic anhydride-styrene copolymer in an alcohol-water mixture wetting agent TEGO produced by Goldschmidt Chemical Corporation, Hopewell, Va., to prevent or avoid the undesirable formation of clumps. In practice, the compositional inclusion of between about 1 and 2 wt. % of the maleic anhydride-styrene copolymer in an alcohol-water mixture wetting agent TEGO 750 has been found generally effective in preventing or avoiding undesirable clump formation.

The pyrotechnic mixture of the invention desirably yields or otherwise results in a lower all-fire result (0.99999 predicted reliability at 95 percent confidence) with conventional bridgewire firing signal devices, as compared to standard initiator pyrotechnic compositions. Those skilled in the art and guided by the teachings herein provided will appreciate that the achieving or realizing of a lower all-fire result is an important factor or criterion in meeting industry demands for new initiator developments.

As will be appreciated, the compositions in accordance with the invention can be incorporated, utilized or practiced in conjunction with a variety of different structures, assemblies and systems. As representative, the FIGURE illustrates an initiator device or assembly, generally designated by the reference numeral 10. The initiator device 10 includes a charge holder housing 12, such as formed of stainless steel or other suitable material. The charge holder housing 12 forms or otherwise provides a charge-containing volume, designated by the reference numeral 14, within which is contained a supply or charge of the subject pyrotechnic composition described above and here designated by the reference numeral 16.

As shown, the charge holder housing 12 can desirably be sufficiently sized such as to permit the housing or containment therewithin of variously sized igniter pyrotechnic charges such as to satisfy the requirements for various particular applications. As such, a void volume 20 may remain in the housing 12 after the loading of the charge 16 therewithin.

Alternatively, the charge holder housing 12 may be specifically sized and tailored to meet the requirements of a specific application. In such situations, the charge holder can, if desired, be sized such as to avoid the inclusion of and significant void volume.

The initiator device also includes a body 22 such as adapted or suited for the secure positioning and placement of the initiator device 10 in a larger assembly such as an inflatable restraint system inflator, as described above, for example. The initiator device body 22, as described in greater detail below, can desirably be formed at least in part by an insulating material. For example and as will be appreciated by those skilled in the art and guided by the teachings herein provided, various insulating materials including various plastic or polymer materials are well-suited for electrical insulation and injection molding. In accordance with one embodiment of the invention the initiator device body 22 can desirably be formed of molded nylon.

The initiator device 10 further includes a metal eyelet 24 such as formed of stainless steel. The eyelet has a bore 26 formed therein. A first conductive pin 30 is positioned through the bore 26 and held in place by a glass or other suitable insulator 32. The first conductive pin 30 has an outer connection end 34 and an opposed inner terminal end 36. A cap or cup member 40, such as formed of stainless steel, surrounds, covers or otherwise encloses the charge-containing volume 14 and the charge 16 contained therewithin. The cap member 40 is suitably joined or connected to the eyelet 24, such by welding. The initiator device 10 also includes a second conductive pin 42. The second conductive pin 42 has an outer connection end 44 and an opposed inner terminal end 46.

An initiator transducer 50 couples the first and second conductive pins 30 and 42 either directly or, as shown, via the eyelet 24. The initiator transducer 50 serves to ignite the charge 16 when properly actuated. As will be appreciated by those skilled in the art and guided by the teaching herein provided, initiator devices in accordance with the invention may incorporate or include various initiator transducer elements or components such as including but not necessarily limited to bridgewire, semiconductor bridge (SCB), thin film bridge, fiber optic coupled laser and direct laser diode firing signal devices.

The initiator device body 22 provides electrical insulation between the first and second conductive pins 30 and 42, respectively. The initiator device 10 may also include an insulating cover 54, such as formed of an insulating plastic or polymer material, provided about the exterior of the cup member 40.

The pyrotechnic composition mixture of the invention can be made as a slurry and loaded onto a bridgewire or other firing signal device and then dried and optionally pressed, such as described in Hamilton et al., U.S. Pat. No. 5,686,691, issued Nov. 11, 1997 and the disclosure of which is hereby incorporated herein in its entirety. Alternatively, the pyrotechnic composition mixture of the invention can be made or formed as a dry granule and loaded into an appropriate initiator device in a conventional manner as is known in the art.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Example 1

In this example, a pyrotechnic mixture in accordance with the invention was prepared. As a first step, each of the ingredients identified in TABLE 1, below, were weighed to the respective specified mass.

TABLE 1

| Ingredient | Mass (grams) |
|---|---|
| dispersant (75 wt. % n-propyl alcohol, 25 wt. % $H_2O$) | 300.0 |
| wetting agent (TEGO 750) | 1.5 |
| Iron Blue Pigment (MANOX 4050, CAS-25869-00-5) | 70.0 |
| potassium perchlorate (CAS 7778-74-7) | 120.0 |
| hydroxypropyl cellulose (CAS-90004-64-2) | 0.5 |

The TEGO 750 wetting agent was added to the dispersant liquid to form a dispersant mixture. The dispersant mixture was then placed in a table-top blender having rheostat speed control. The blender was then set on low speed (30 on the rheostat control, blender control on high). The MANOX 4050 Iron Blue Pigment was then slowly added to the blender while the blending speed was appropriately increased so as to maintain a constant vortex.

After all of the Iron Blue Pigment had been added to the blender, the blender was set at maximum blending speed and the contents were so blended for 10 minutes.

At this point, the potassium perchlorate was added to the blender contents and the contents were blended for 1 minute.

At this point, the hydroxypropyl cellulose was added to the blender contents and the contents were blended for 5 minutes.

The blend mixture was then placed in a vacuum oven and treated by removing solvent to adjust the volatile content to 32 wt. %, as confirmed via an assay of approximately 1 gram.

Example 2

In this example, fifty (50) test initiator devices each containing an 80-gram sample of the pyrotechnic mixture of Example 1 and having a bridgewire A-7 firing signal device initiator transducer were prepared and tested in a conventional Bruceton method to determine sensitivity.

Results

These tests showed an all-fire level of 0.7338 amps at 0.999999 reliability at 95% confidence level. An all-fire level of less than 0.8 amps was the target.

While lead styphnate has been commonly used in an effort to meet such initiator device primer material requirement, there is mounting interest and desire to minimize, avoid and/or eliminate the presence or inclusion of lead, lead-based and lead-containing materials in such or similar applications. These results highlight the utility of the subject compositions in such applications.

Thus, the invention provides improved pyrotechnic compositions such as used in initiator devices and improved initiator devices having a low firing energy. In particular, the compositions of the invention are high energy compositions which are well suited as ignition or primer materials. Further, the compositions of the invention are relatively safe to handle in either a slurry or dry form, as compared to currently used initiator primer materials such as lead styphnate and ZPP, for example. Still further, the compositions of the invention advantageously produce, provide or otherwise desirably result in the formation of additional gaseous reaction products.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A gas generant pyrotechnic composition comprising:

a mixture containing:

a fuel component comprising a quantity of at least one Iron Blue Pigment;

an oxidizer component comprising at least one oxidizer effective, upon reaction initiation with at least a portion of the quantity of the at least one Iron Blue Pigment, to produce gaseous reaction products and at least about 0.25 wt. % and no more than about 5 wt. % of at least one additive selected from the group consisting of binders, rheology enhancers and wetting agents, wherein the composition contains a maleic anhydride-styrene copolymer in an alcohol-water mixture wetting agent.

2. An initiator device comprising:

a charge holder housing containing a gas generant pyrotechnic composition comprising a mixture containing:

a fuel component comprising a quantity of at least one Iron Blue Pigment and an oxidizer component comprising at least one oxidizer effective, upon reaction initiation with at least a portion of the quantity of the at least one Iron Blue Pigment, to produce gaseous reaction products and an initiator transducer in direct contact and reaction initiating communication with at least a portion of the gas generant pyrotechnic composition contents of the housing.

3. The initiator device of claim 2 wherein the initiator transducer comprises a bridgewire firing signal device.

4. The initiator device of claim 2 wherein the initiator transducer comprises a SCB firing signal device.

5. The initiator device of claim 2 wherein the initiator transducer comprises a thin film bridge firing signal device.

6. The initiator device of claim 2 wherein the initiator transducer comprises a firing signal device selected from the group consisting of a fiber optic coupled laser and a direct laser diode.

7. The initiator device of claim 2 wherein the oxidizer component of the gas generant pyrotechnic composition comprises potassium perchlorate.

8. The initiator device of claim 7 wherein the gas generant pyrotechnic composition contains about 50 to about 70 wt. % potassium perchlorate and has an Iron Blue Pigment relative content of about 30 to about 50 wt. %.

9. The initiator device of claim 2 wherein the gas generant pyrotechnic composition additionally comprises at least about 0.25 wt. % and no more than about 5 wt. % of at least one additive selected from the group consisting of binders, rheology enhancers and wetting agents.

10. An initiator device comprising:

a charge holder housing containing a gas generant pyrotechnic composition comprising:

a mixture containing:

a fuel component comprising a quantity of at least one Iron Blue Pigment;

an oxidizer component comprising at least one oxidizer effective, upon reaction initiation with at least a portion of the quantity of the at least one Iron Blue Pigment, to produce gaseous reaction products; and at least about 0.25 wt. % and no more than about 5 wt. % of at least one additive selected from the group consisting of binders, rheology enhancers and wetting agents and an initiator transducer in reaction initiating communication with at least a portion of the gas generant pyrotechnic composition contents of the housing, wherein the gas generant pyrotechnic composition contains a maleic anhydride-styrene copolymer in an alcohol-water mixture wetting agent.

11. An initiator device comprising:

a charge holder housing containing a gas generant pyrotechnic composition, the gas generant pyrotechnic composition comprising;

a fuel component comprising a quantity of at least one Iron Blue Pigment, the gas generant pyrotechnic composition having an Iron Blue Pigment relative content of about 30 to about 50 wt. %, an oxidizer component comprising potassium perchlorate and effective, upon reaction initiation with at least a portion of the quantity of the at least one Iron Blue Pigment, to produce gaseous reaction products, the gas generant pyrotechnic composition having a potassium perchiorate relative content of about 50 to about 70 wt. %, and at least about 0.25 wt. % and no more than about 5 wt. % of at least one additive selected from the group consisting of binders, rheology enhancers and wetting agents and an initiator transducer in direct contact and reaction initiating communication with at least a portion of the gas generant pyrotechnic composition contents of the housing.

12. The initiator device of claim 11 wherein the initiator transducer comprises a bridgewire firing signal device.

13. The initiator device of claim 11 wherein the initiator transducer comprises a SCB firing signal device.

14. The initiator device of claim 11 wherein the initiator transducer comprises a thin film bridge firing signal device.

15. The initiator device of claim 11 wherein the initiator transducer comprises a firing signal device selected from the group consisting of a fiber optic coupled laser and a direct laser diode.

16. The initiator device of claim 2 wherein the gas generant pyrotechnic composition oxidizer component comprises potassium perchlorate.

17. The initiator device of claim 16 wherein the gas generant pyrotechnic composition contains about 50 to about 70 wt. % potassium perchiorate and has an Iron Blue Pigment relative content of about 30 to about 50 wt. %.

18. The initiator device of claim 2 wherein the gas generant pyrotechnic composition additionally comprises at least about 0.25 wt. % and no more than about 5 wt. % of at least one additive selected from the group consisting of binders, rheology enhancers and wetting agents.

* * * * *